US005477970A

United States Patent [19]

Watt et al.

[11] Patent Number: 5,477,970

[45] Date of Patent: Dec. 26, 1995

[54] ADJUSTABLE PRODUCE DISPLAY RACK

[76] Inventors: James Watt, 82 Shawinigan Drive S.W., Calgary, Alberta, Canada, T2Y 1Z8; Terrance Gaskell, 181 Woodbend Way, Okotoks, Alberta, Canada, T0L 1T5

[21] Appl. No.: 264,521

[22] Filed: Jun. 23, 1994

[51] Int. Cl.[6] ..... A47F 5/00

[52] U.S. Cl. ..... 211/175; 211/181; 211/187

[58] Field of Search ..... 211/175, 181, 211/127, 187, 150

[56] References Cited

U.S. PATENT DOCUMENTS

| | | | |
|---|---|---|---|
| 3,385,452 | 5/1968 | Dantino et al. | 211/175 |
| 3,385,453 | 5/1968 | Dantino et al. | 211/175 |
| 3,905,286 | 9/1975 | LeGrady | 211/181 X |
| 5,314,080 | 5/1994 | Wentworth | 211/181 |

*Primary Examiner*—Robert W. Gibson, Jr.
*Attorney, Agent, or Firm*—Anthony R. Lambert

[57] ABSTRACT

An adjustable produce display rack is described which includes a planar base having a first end, a second end, and an upwardly projecting front rail at the first end. At least two intermediate supports are provided. Each of the intermediate supports has a first end, a second end, a bottom and a top. The first end is angled toward the second end at an upward angle extending from the bottom toward the top. The intermediate supports are locked to the planar base in a selected position relative to the first end and the second end of the planar base. An upper support member is pivotally mounted to each of the at least two intermediate supports. The upper support member has a first portion and a second portion. The first portion is angled at an angle compatible with the first end of the intermediate support such that the first portion of the upper support overlies the first end of the intermediate support. The first portion of the upper support is telescopically extendable relative to the first end of the intermediate support upon pivotal movement of the upper support relative to the intermediate support. The upper support is locked in a selected pivotal position relative to the intermediate support.

14 Claims, 5 Drawing Sheets

ADJUSTABLE PRODUCE DISPLAY RACK

The present invention relates to an adjustable produce display rack.

BACKGROUND OF THE INVENTION

Retail stores wish to make their produce displays as appealing to the eye as possible. If produce is attractively displayed the consumer will be much more inclined to purchase it. It is generally considered desirable to have all the produce displayed at the same height. This creates difficulties due to the differing sizes of the produce. For example, it takes several layers of radishes to achieve the same height as a single layer of lettuce. Creating multiple layers of smaller produce is a poor practise as it results in an inordinate amount of spoilage. In order to even the height of the produce, boxes and crates are used. Boxes and crates have a limited useful life as they suffer water damage when the produce is watered.

Produce display racks were developed as substitutes for boxes and crates. It is preferable that the produce display rack be adjustable; as the produce section of retail stores undergo frequent changes. U.S. Pat. No. 5,170,897 and U.S. Pat. No. 4,077,522 are examples of adjustable produce display racks. These display racks are limited in their ability to adjust for height, width, and length. The adjustment of these racks is a major undertaking which must be carefully pre-planned. The implementation of the plan is time consuming and requires close managerial supervision. The weakness in existing adjustable display racks is especially apparent during major sales. When a major sale features produce, it is not uncommon to run out of one or more types of produce. Rather than leave an empty space, a produce manager will fill the space left by the sold out produce with other available produce. The existing racks cannot be adjusted as rapidly as desired to a height, width and length that will enable the empty space to be filled with other available produce while maintaining the objective of having a consistent display height for all produce.

SUMMARY OF THE INVENTION

What is required is an adjustable produce display rack that can be adjusted comparatively easily and rapidly and has a greater range of height, width and length adjustment.

According to the present invention there is provided an adjustable produce display rack which includes a planar base having a first end, a second end, and an upwardly projecting front rail at the first end. At least two intermediate supports are provided. Each of the intermediate supports has a first end, a second end, a bottom and a top. The first end is angled toward the second end at an upward angle extending from the bottom toward the top. Means is provided for locking the intermediate supports to the planar base in a selected position relative to the first end and the second end of the planar base. An upper support member is pivotally mounted to each of the at least two intermediate supports. The upper support member has a first portion and a second portion. The first portion is angled at an angle compatible with the first end of the intermediate support such that the first portion of the upper support overlies the first end of the intermediate support. The first portion of the upper support is telescopically extendable relative to the first end of the intermediate support upon pivotal movement of the upper support relative to the intermediate support. Means is provided for locking the upper support in a selected pivotal position relative to the intermediate support.

The adjustable produce display rack, as described above, provides greater flexibility with respect to height, width and length adjustment. The width is adjustment is accomplished through the use of a plurality of intermediate supports. The intermediate supports can either be placed a differing heights to maintain differing types of produce at a common display height or the intermediate supports can be placed at the same height to accommodate a larger display of the same or like-sized produce. The length adjustment is accomplished through the relative placement of the intermediate supports on the planar base. The intermediate supports can be locked in different positions relative to the first end and second end of the planar base. The height adjustment is accomplished through pivoting of upper supports. The upper support overlies the first end of the intermediate support and is telescopically extendable relative to the first end of the intermediate support upon pivotal movement of the upper support relative to the intermediate support.

There are a variety of ways to pivotally attach the upper supports to intermediate supports. It is preferred that the relative angle between the first portion and the second portion of the upper support is such that upon pivotal movement of the upper support the second portion of the upper support is maintained in a substantially horizontal position. A hinge configuration with which beneficial results have been obtained has a first hinge member pivotally mounted to the second end of the intermediate support and a second hinge member pivotally mounted to the upper support. The first hinge member and the second hinge member are pivotally connected.

It is also preferred that the second portion of the upper support be telescopically extendible. This enables an adjustment of the length of the upper support is effected to accommodate the position of the intermediate support relative to the second end of the base.

There are a variety of ways to lock the upper supports in a pivotal position relative to the intermediate supports. Beneficial results have been obtained when the first end of the intermediate support has a plurality of spaced bars and the upper support is overbalanced such that it tends to pivot toward the first end of the intermediate support. The means for locking the upper support in a selected pivotal position relative to the intermediate support with such a configuration can merely consist of a tab which depends from the first portion of the upper support. The depending tab engages a selected one of bars at the first end of the intermediate support thereby locking the upper support in a selected pivotal position relative to the intermediate support.

Although beneficial results may be obtained through the use of the produce display rack, as described above, it is desirable that the produce display rack be able to be used in display cases produced by a variety of manufacturers. Even more beneficial results may, therefore, be obtained when the base has projecting hook-like members at least at one end whereby the base is secured between sidewalls of a display case.

It is important that the produce display rack be able to support produce of different sizes. At the same time, it is undesirable that the produce display rack trap and retain moisture that could contribute to a rotting of the produce. It is preferred that produce supporting areas, such as the front rail, the first end of the base, and the upper support have a plurality of spaced bars whereby produce is supported.

There are a variety of ways in which the intermediate supports may be locked into position on the planar base. Beneficial results have been obtained when the base has a plurality of female receptacles commencing adjacent the second end and spaced at intervals toward the first end, and the intermediate support has a depending male member adjacent the second end. The male member of the intermediate support is insertable into a selected one of the female receptacles on the base to lock the intermediate support in a selected position relative to the first end and the second end of the base.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
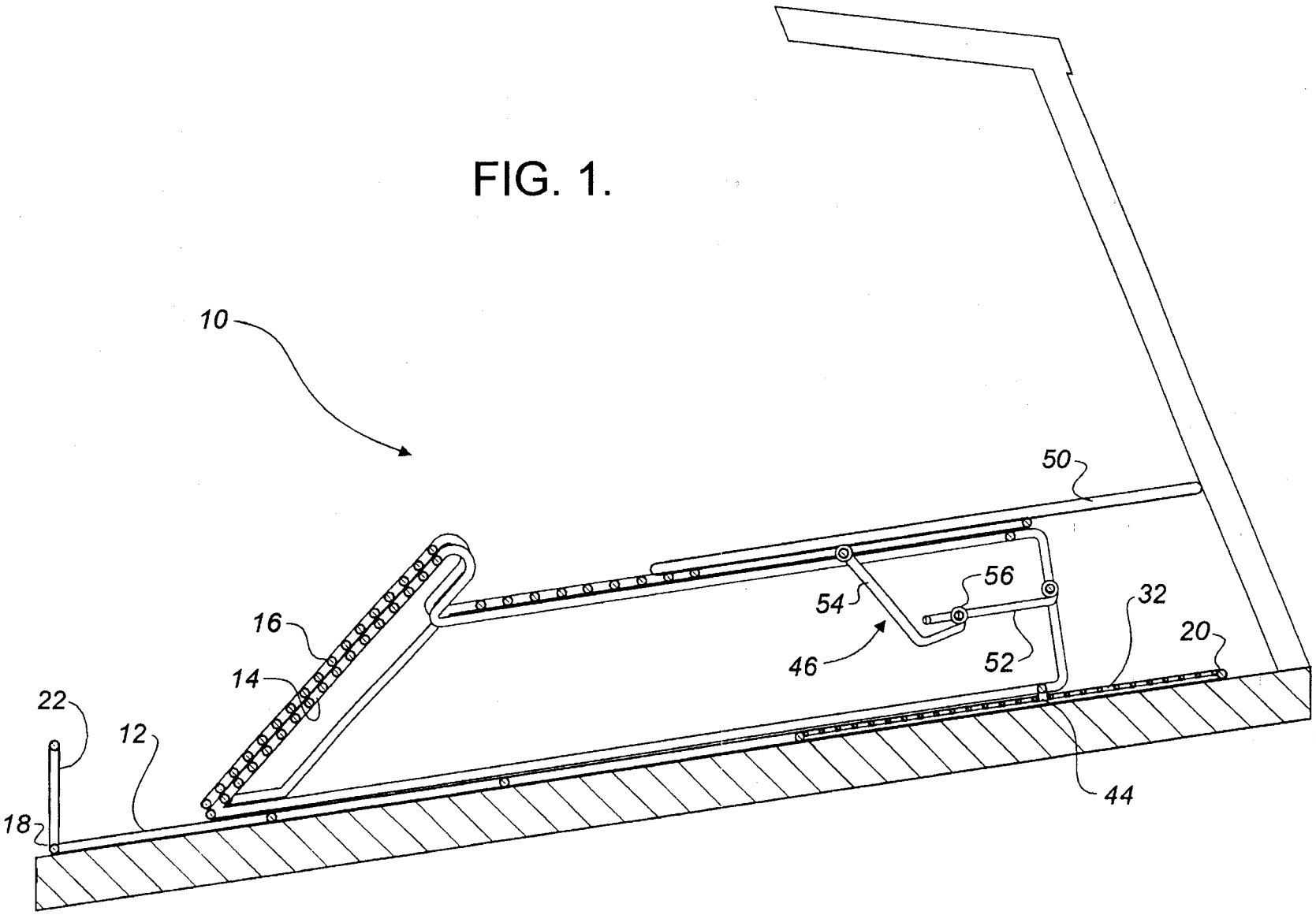
FIG. 1 is a side elevation view of a produce display rack constructed in accordance with the teachings of the present invention in a first position.

The preferred embodiment, an adjustable produce display rack generally identified by reference numeral 10, will now be described with reference to FIGS. 1 through 6.

Figure 2:
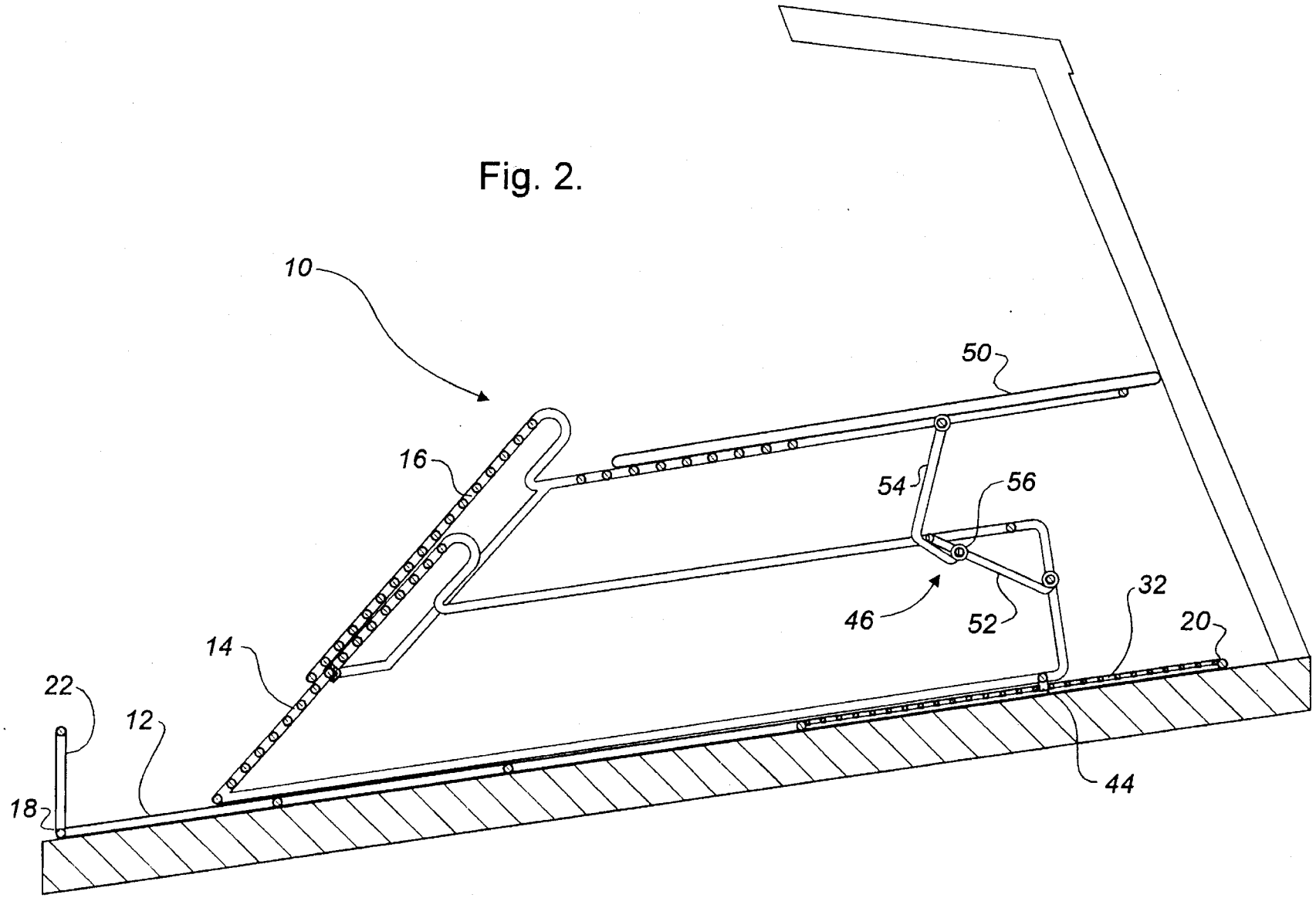
FIG. 2 is a side elevation view of a produce display rack constructed in accordance with the teachings of the present invention in a second position.
Figure 3:
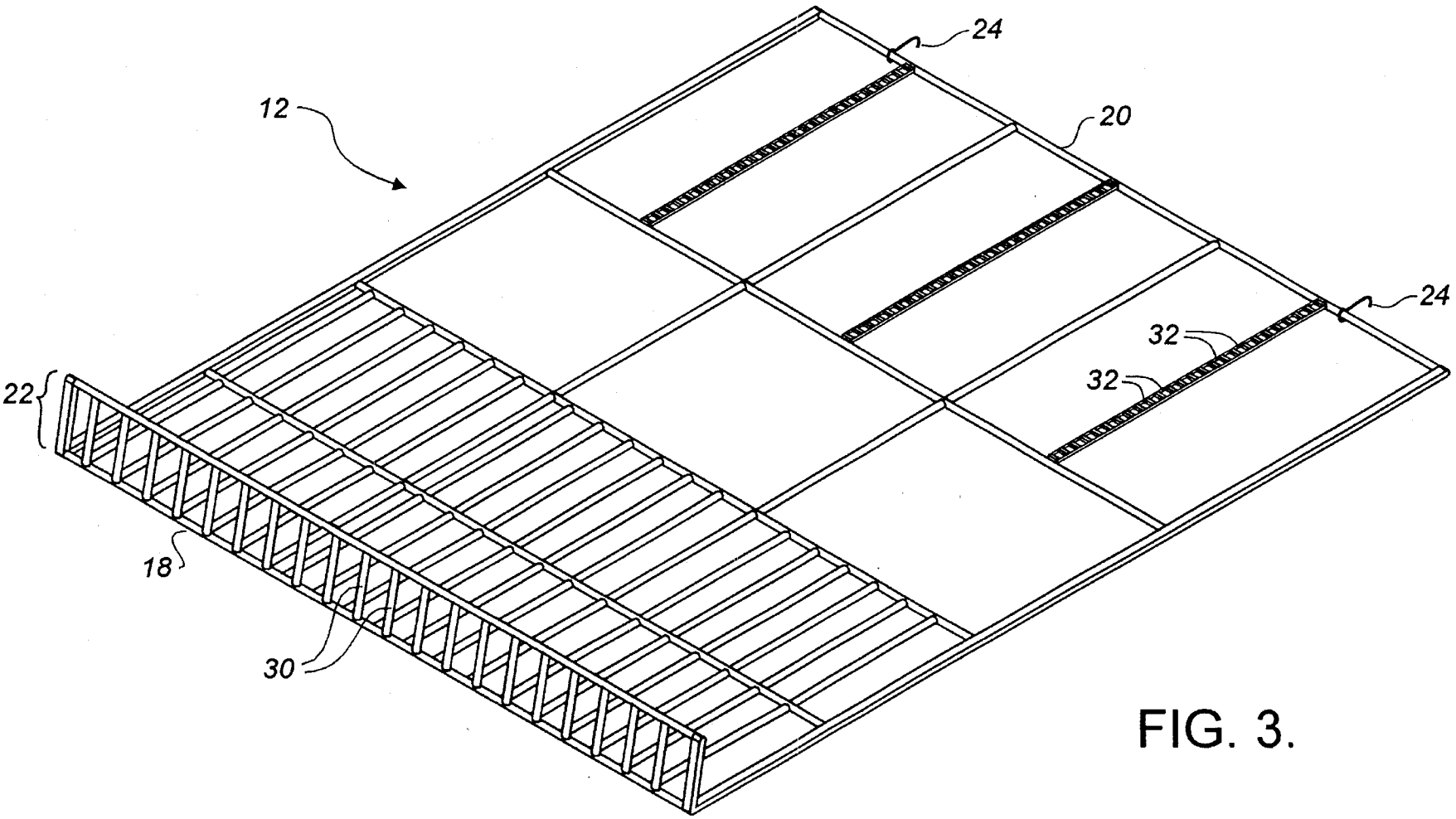
FIG. 3 is a perspective view of a base portion of the produce display rack illustrated in FIGS. 1 and 2.
Figure 4:
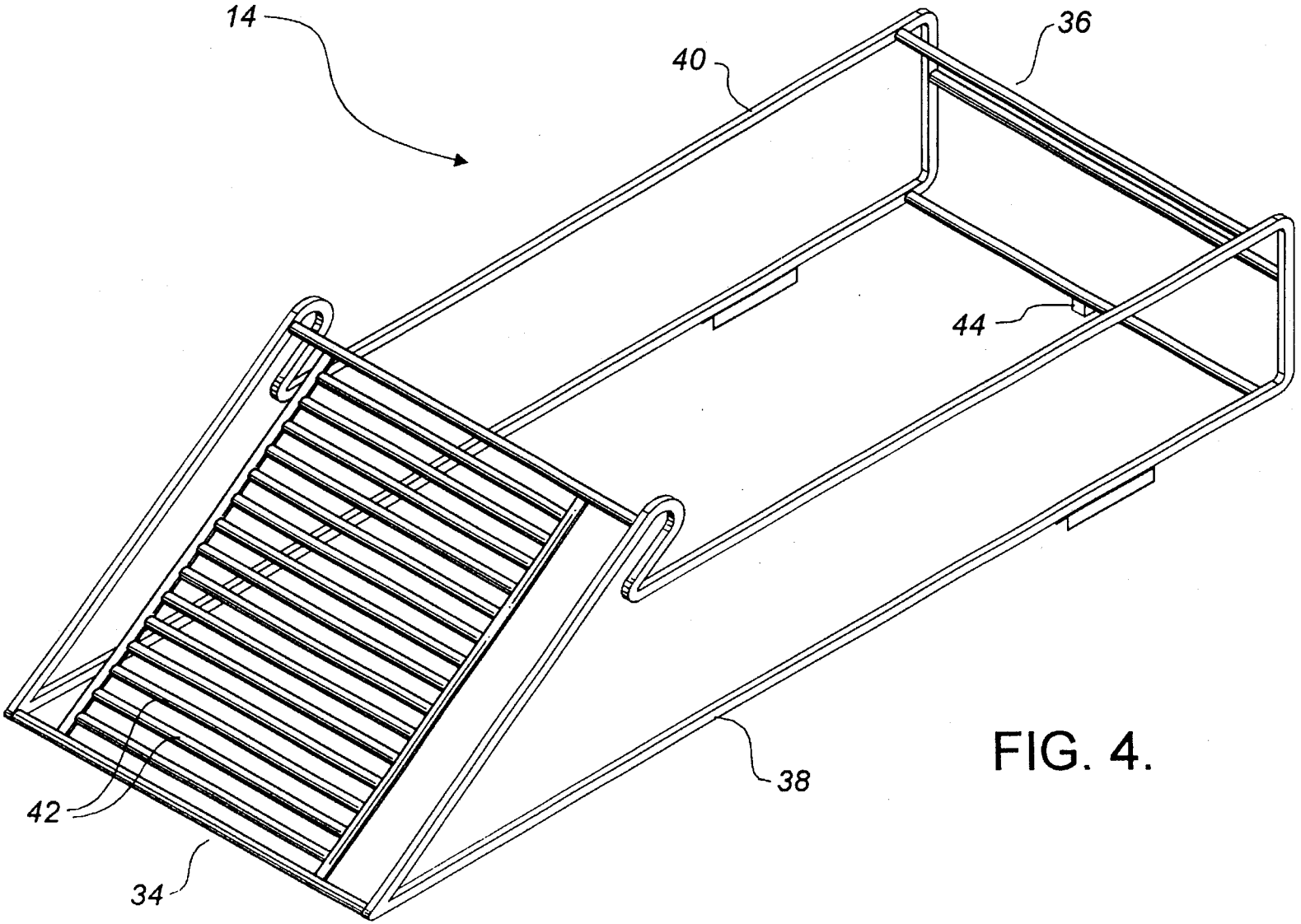
FIG. 4 is a perspective view of an intermediate support portion of the produce display rack illustrated in FIGS. 1 and 2.
Figure 5:
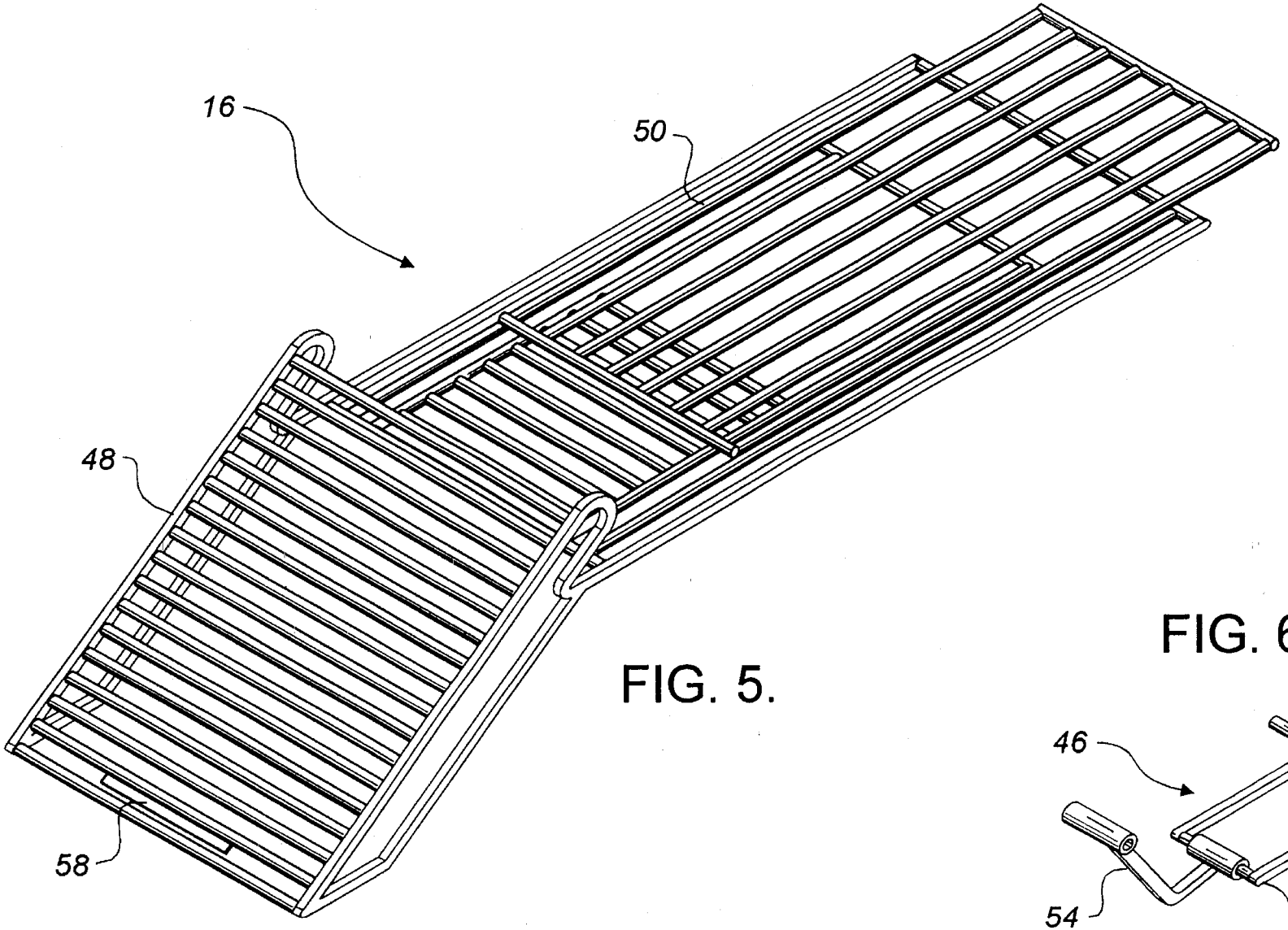
FIG. 5 is a perspective view of an upper support portion of the produce display rack illustrated in FIGS. 1 and 2.
Figure 6:
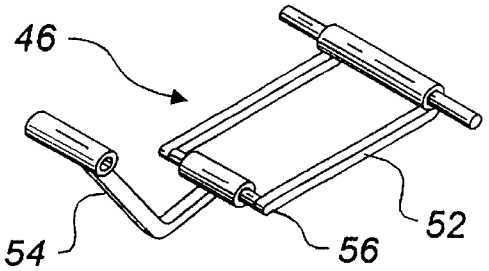
FIG. 6 is a perspective view of a hinge from the produce display rack illustrated in FIGS. 1 and 2.

Adjustable produce display rack 10 consists of three primary components; a planar base 12 (illustrated in FIG. 3), three intermediate supports 14 (illustrated in FIG. 4) and three upper supports 16 (illustrated in FIG. 5). Referring to FIG. 3, base 12 is made of wire frame construction. It has a first end 18, a second end 20, and an upwardly projecting front rail 22 at first end 18. Hook-like projections 24 are positioned at second end 20. Hook-like projections 24 permit base 12 to be secured within a display case (not shown). The wire frame construction of base 12 includes a plurality of spaced bars 30 whereby produce (not shown) is supported by front rail 22 and first end 18 of base 12. Base 12 has a plurality of female receptacles 32 commencing adjacent second end 20 and spaced at intervals toward first end 18. Referring to FIG. 4, each of intermediate supports 14 have a first end 34, a second end 36, a bottom 38 and a top 40. First end 34 is angled toward second end 36 at an upward angle extending from bottom 38 toward top 40. First end 34 of each intermediate support 14 has a plurality of spaced apart transversely extending bars 42. Each intermediate support 14 has a depending male member 44 adjacent second end 36. Referring to FIGS. 1 and 2, each upper support member 16 is pivotally mounted by means of a hinge 46 to one of intermediate supports 14. Each upper support 16 is overbalanced such that it tends to pivot toward first end 34 of intermediate support 14. Referring to FIG. 5, each upper support 16 has a first portion 48 and a second portion 50. First portion 48 is angled at an angle compatible with first end 34 of intermediate support 14. Referring to FIG. 1, first portion 48 of upper support 16 overlies first end 34 of intermediate support 14. As is apparent from a comparison of FIGS. 1 and 2, first portion 48 of upper support 16 is telescopically extendable relative to first end 34 of intermediate support 14 upon pivotal movement of upper support 16 relative to intermediate support 14. The relative angle between first portion 48 and second portion 50 of upper support 16 is such that upon pivotal movement of upper support 16 to telescopically extend first portion 48 of upper support 16 relative to first end 34 of intermediate support 14, second portion 50 of upper support 16 is maintained in a substantially horizontal position. As is apparent from a comparison of FIGS. 1 and 2, second portion 50 of upper support is also telescopically extendible. Referring to FIG. 6, hinge 46 has a first hinge member 52 pivotally mounted to second end 36 of intermediate support 14 and a second hinge member 54 pivotally mounted to upper support 16. First hinge member 52 and second hinge member 54 are pivotally connected at pivotal connection 56. Referring to FIG. 5, a tab 58 depends from first portion 48 of each of upper support members 16.

The use and operation of produce display rack 10 will now be described with reference to FIGS. 1 through 6. Base 12 is placed onto a display case, as illustrated in FIGS. 1 and 2. Depending male member 44 of intermediate support 14, illustrated in FIG. 4, is then inserted into a selected one of female receptacles 32 on base 12 illustrated in FIG. 3. This serves to lock intermediate support 14 to base 12 in a selected position between to first end 18 and second end 20. Upper support 16 is then pivoted to the desired height. Referring to FIGS. 1 and 2, upon such pivotal movement first portion 48 of upper support 16 telescopically extends relative to first end 34 of intermediate support 14. Second portion 50 of upper support 16 maintains a substantially horizontal position throughout the pivotal movement. Depending tab 58 on first portion 48 of upper support 16, illustrated in FIG. 5, engages a selected one of transverse bars 42 at first end 34 of intermediate support 14, illustrated in FIG. 4. The engagement between tab 58 and transverse bar 42 limits forward pivoting of upper support 16 locking upper support 16 in a selected pivotal position relative to intermediate support 14. An adjustment of the length of upper support 16 is effected by telescopic extension of second portion 50. This accommodates the position of intermediate support 14 relative to second end 20 of base 12.

It will be apparent to one skilled in the art that produce display rack 10, as described, can be quickly adjusted to display all produce at a consistent height. If the produce is all the same size, upper supports 16 are maintained at the same height. If produce of a smaller size, such as radishes, is to be displayed alongside a larger size of produce, such as lettuce, the positioning of intermediate support 14 on base 12 and the height of upper support 16 can be altered as required to maintain a consistent height. It will also be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. An adjustable produce display rack, comprising:

a. a planar base having a first end, a second end, and an upwardly projecting front rail at the first end;

b. at least two intermediate supports, each of the intermediate supports having a first end, a second end, a bottom and a top, the first end being angled toward the second end at an upward angle extending from the bottom toward the top;

c. means for locking the intermediate supports to the planar base in a selected position relative to the first end and the second end of the planar base;

d. an upper support pivotally mounted to each of the at least two intermediate supports, the upper support having a first portion and a second portion, the first portion being angled at an angle compatible with the first end of the intermediate support such that the first portion of the upper support overlies the first end of the intermediate support, the first portion of the upper support being telescopically extendable relative to the first end of the intermediate support upon pivotal movement of the upper support relative to the intermediate support; and e. means for locking the upper support in a selected pivotal position relative to the intermediate support.

2. The adjustable produce display rack as defined in claim 1, wherein the relative angle between the first portion and the second portion of the upper support is such that upon pivotal movement of the upper support the second portion of the upper support is maintained in a substantially horizontal position.

3. The adjustable produce display rack as defined in claim 1, wherein the second portion of the upper support is telescopically extendible whereby an adjustment of the length of the upper support is effected to accommodate the position of the intermediate support relative to the second end of the base.

4. The adjustable produce display rack as defined in claim 1, wherein the first end of the intermediate support has a plurality of spaced bars and the upper support is overbalanced such that it tends to pivot toward the first end of the intermediate support, the means for locking the upper support in a selected pivotal position relative to the intermediate support being a tab which depends from the first portion of the upper support, the depending tab engaging a selected one of bars at the first end of the intermediate support thereby locking the upper support in a selected pivotal position relative to the intermediate support.

5. The adjustable produce display rack as defined in claim 1, wherein the base has projecting hook-like members at least at one end whereby the base is secured between sidewalls of a display case.

6. The adjustable produce display rack as defined in claim 1, wherein the front rail and first end of the base have a plurality of spaced bars whereby produce is supported by the front rail and the base.

7. The adjustable produce display rack as defined in claim 1, wherein the upper support is pivotally mounted to the intermediate support by means of a hinge, the hinge having a first hinge member pivotally mounted to the second end of the intermediate support, a second hinge member pivotally mounted to the upper support, the first hinge member and the second hinge member being pivotally connected.

8. The adjustable produce display rack as defined in claim 1, wherein the base has a plurality of female receptacles commencing adjacent the second end and spaced at intervals toward the first end, and the intermediate support has a depending male member adjacent the second end, such that the male member of the intermediate support is insertable into a selected one of the female receptacles on the base to lock the intermediate support in a selected position relative to the first end and the second end of the base.

9. An adjustable produce display rack, comprising:

a. a planar base having a first end, a second end, and an upwardly projecting front rail at the first end;

b. at least two intermediate supports, each of the intermediate supports having a first end, a second end, a bottom and a top, the first end being angled toward the second end at an upward angle extending from the bottom toward the top, the first end of the intermediate support having a plurality of spaced apart transversely extending bars;

c. means for locking the intermediate supports to the planar base in a selected position relative to the first end and the second end of the planar base;

d. an upper support pivotally mounted to each of the at least two intermediate supports, each of the upper supports being overbalanced such that it tends to pivot toward the first end of the intermediate support, the upper support having a first portion and a second portion, the first portion being angled at an angle compatible with the first end of the intermediate support such that the first portion of the upper support overlies the first end of the intermediate support, the first portion of the upper support being telescopically extendable relative to the first end of the intermediate support upon pivotal movement of the upper support relative to the intermediate support, the relative angle between the first portion and the second portion of the upper support is such that upon pivotal movement of the upper support to telescopically extend the first portion of the upper support relative to the first end of the intermediate support, the second portion of the upper support is maintained in a substantially horizontal position, the second portion of the upper support being telescopically extendible whereby an adjustment of the length of the upper support is effected to accommodate the position of the intermediate support relative to the second end of the base; and e. a tab depending from the first portion of each of the upper supports, the depending tab engaging a selected one of transverse bars at the first end of the intermediate support thereby stopping forward pivoting of the upper support and locking the upper support in a selected pivotal position relative to the intermediate support.

10. The adjustable produce display rack as defined in claim 9, wherein the base has projecting hook-like members at least at one end, whereby the base is secured between sidewalls of a display case.

11. The adjustable produce display rack as defined in claim 9, wherein the front rail and first end of the base have a plurality of spaced bars whereby produce is supported by the front rail and the base.

12. The adjustable produce display rack as defined in claim 9, wherein the upper support is pivotally mounted to the intermediate support by means of a hinge, the hinge having a first hinge member pivotally mounted to the second end of the intermediate support, a second hinge member pivotally mounted to the upper support, the first hinge member and the second hinge member being pivotally connected.

13. The adjustable produce display rack as defined in claim 9, wherein the base has a plurality of female receptacles commencing adjacent the second end and spaced at intervals toward the first end, and the intermediate support has a depending male member adjacent the second end, such that the male member of the intermediate support is insertable into a selected one of the female receptacles on the base to lock the intermediate support in a selected position relative to the first end and the second end of the base.

14. An adjustable produce display rack, comprising:

a. a planar base having a first end, a second end, and an upwardly projecting front rail at the first end, the base having hook-like projections at the second end whereby the base is secured between sidewalls of a display case, the front rail and first end of the base have a plurality of spaced bars whereby produce is supported by the front rail and the base, the base having a plurality of female receptacles commencing adjacent the second end and spaced at intervals toward the first end;

b. at least two intermediate supports, each of the intermediate supports having a first end, a second end, a bottom and a top, the first end being angled toward the second end at an upward angle extending from the bottom toward the top, the first end of the intermediate support having a plurality of spaced apart transversely extending bars, the intermediate support having a depending male member adjacent the second end, such that the male member of the intermediate support is insertable into a selected one of the female receptacles on the base to serve as means for locking the intermediate supports to the planar base in a selected position relative to the first end and the second end of the planar base;

c. an upper support pivotally mounted by means of a hinge to each of the at least two intermediate supports, each of the upper supports being overbalanced such that it tends to pivot toward the first end of the intermediate support, the upper support having a first portion and a second portion, the first portion being angled at an angle compatible with the first end of the intermediate support such that the first portion of the upper support overlies the first end of the intermediate support, the first portion of the upper support being telescopically extendable relative to the first end of the intermediate support upon pivotal movement of the upper support relative to the intermediate support, the relative angle between the first portion and the second portion of the upper support is such that upon pivotal movement of the upper support to telescopically extend the first portion of the upper support relative to the first end of the intermediate support, the second portion of the upper support is maintained in a substantially horizontal position, the second portion of the upper support being telescopically extendible whereby an adjustment of the length of the upper support is effected to accommodate the position of the intermediate support relative to the second end of the base, the hinge having a first hinge member pivotally mounted to the second end of the intermediate support, a second hinge member pivotally mounted to the upper support the first hinge member and the second hinge member being pivotally connected; and d. a tab depending from the first portion of each of the upper supports, the depending tab engaging a selected one of transverse bars at the first end of the intermediate support thereby stopping forward pivoting of the upper support and locking the upper support in a selected pivotal position relative to the intermediate support.

* * * * *